United States Patent [19]

Waterfall

[11] 3,969,917

[45] July 20, 1976

[54] HEAT TREATMENT POTS

[75] Inventor: Frederick David Waterfall, Harborne, England

[73] Assignee: Frederick David Waterfall

[22] Filed: Mar. 26, 1974

[21] Appl. No.: 454,865

[30] Foreign Application Priority Data

| | | |
|---|---|---|
| Apr. 3, 1973 | United Kingdom | 15852/73 |
| June 30, 1973 | United Kingdom | 31266/73 |

[52] U.S. Cl. ..... 72/69; 72/83

[51] Int. Cl.[2] ..... B21D 22/16

[58] Field of Search ..... 72/80, 81, 82, 83, 84, 72/85, 700, 69; 432/265; 266/39

[56] References Cited

UNITED STATES PATENTS

| | | | |
|---|---|---|---|
| 358,438 | 3/1887 | Duff | 72/83 |
| 438,407 | 10/1890 | Dewey | 113/120 H |
| 648,929 | 5/1900 | Deming | 113/120 H |
| 3,355,920 | 12/1967 | Ellenburg | 72/83 |
| 3,372,567 | 3/1968 | Jensen et al. | 72/83 |

FOREIGN PATENTS OR APPLICATIONS

| | | | |
|---|---|---|---|
| 464,772 | 8/1928 | Germany | 72/82 |
| 348,673 | 10/1960 | Switzerland | 72/83 |
| 908,153 | 10/1962 | United Kingdom | 72/83 |

OTHER PUBLICATIONS

*Metals Handbook*, 8th Ed., vol. 4, pp. 434 & 435, American Society For Metals, 1969.

"Metal Spinning By Modern Methods," *Machinery*, Nov. 1945, vol. 52, No. 3, pp. 141–148, by Edwin Weiss.

*Primary Examiner*—Lowell A. Larson
*Attorney, Agent, or Firm*—Cushman, Darby & Cushman

[57] ABSTRACT

A heat treatment pot for holding molten salts is produced by a spinning process to form the body of the pot from a substantially circular disc blank of heat resisting nickel chromium alloy. In the spinning process, a mandrel is utilized which has a circular end face and an external shape and cross-sectional dimensions complementary to the internal shape and dimensions of said body. The initial diameter of the blank is greater than the diameter of the circular end face of the mandrel by an amount which exceeds at least 90% of the required depth of said body. The blank is applied against the mandrel end face and the spinning process is carried out only to an extent sufficient to bend the blank so as to conform to the shape of the mandrel and to extend the blank along the length of said mandrel for a distance substantially equal to said depth of the body of the pot. The disc blank may be of laminate metal sheet comprising a layer of the nickel chromium alloy clad with a layer of mild steel.

21 Claims, 3 Drawing Figures

HEAT TREATMENT POTS

This invention relates to production of pots, commonly known as "heat treatment salt bath pots" or simply "heat treatment pots", and to the use of said pots for the heat treatment of metals with molten salts.

In some conventional metal heat treatment techniques, such as casehardening, carburising or annealing for example, heat treatment pots as mentioned above are partly filled with chemical mixtures suitable for use as molten heat treatment salts. Each pot is placed in a salt bath furnace in which heat is applied to the outside of the pot until the salt mixture within melts. The salt mixture is raised to the working temperature and the metal parts to be heat treated are then immersed in the molten salt mixture. The temperature of the molten salt mixture is generally in the range 700° – 950° but may sometimes be as high as 1050°C. This process results in a high tendency for oxidation of the pot to occur on the outside by the heating gases, and there may also be a tendency for internal oxidation of the pot above the level of the salt/air interface line as a result of exposure to air in combination with the salt.

At present, some heat treatment pots in use are made of mild steel which is generally formed by pressing, the mild steel being protected on the outside, or both inside and outside, by impregnation with aluminium carried out by heating the mild steel body of the pot in aluminium powder in an inert atmosphere. Despite this surface treatment, however, such pots are still liable to fail in use after a few hundred hours as a result of oxidation of the outside of the pot and consequent perforation.

Because the lifetime of such aluminium treated mild steel pots is therefore generally short, heat treatment pots for holding molten salts have also been used which are made from heat resisting alloy containing nickel and chromium. Some such alloy pots are produced by a process of casting the molten alloy direct into sand moulds. Another method is to form sections of sheets of the nickel chromium alloy and to weld the sections together with an alloy welding rod of similar composition to the sheet.

It has been found, however, that an appreciable percentage of such pots cast from heat resisting alloy also fail prematurely in use as a result of salt penetrating unsound areas or by cracks developing in the wall. Some of the fabricated welded pots, referred to above, also fail prematurely during use, either in the weld or in the metal adjacent the welds.

There has accordingly been a need for an improved method of production of satisfactory heat treatment pots having a relatively long life.

The present invention is based upon the concept of producing a heat treatment pot from blanks of metal sheet, comprising heat resisting nickel chromium alloy, using a metal spinning process.

However, it has been found that conventional metal spinning techniques, which involve a high degree of stretching, flow, and thinning of the metal, could not, in general, be applied to blanks of metal sheet comprising heat resisting nickel chromium alloy so as to produce satisfactory heat treatment pots as specified. Experimental work, however, has resulted in the surprising discovery that satisfactory results could be obtained by adopting an unusual modification of conventional spinning techniques, for metals of the kind in question, the spinning process in this modification being carried out and being controlled in such a manner that in producing the finished bodies of the pots, there is a relatively low degree of stretching of the metal and a relatively low degree of flow of the metal along the length of the mandrel about which the pot bodies are spun.

Thus, according to one aspect of the present invention, in a method of producing a heat treatment pot for holding molten salts, a metal spinning process is used to form the body of the pot from a substantially circular disc blank of metal sheet which comprises heat resisting nickel chromium alloy, the spinning process being carried out, at least in the final stages, whilst the blank is applied to a smaller diameter circular end face of a mandrel having a shape complementary to the internal shape of the pot body finally produced, and said spinning process being so controlled that the pot body thereby produced has a depth which is not greater than 110% of the difference between the initial diameter of the disc blank and the diameter of said circular end face of said mandrel.

From another aspect the invention provides a method of producing a heat treatment pot, for holding molten salts, which has a body of predetermined depth and of predetermined internal shape and cross-sectional dimensions, said method comprising forming the body of the pot by a metal spinning process utilising a mandrel having a circular end face and having an external shape and cross-sectional dimensions complementary to the internal shape and dimensions of said body, said method further including the following steps:

a. providing a blank of metal sheet comprising heat resisting nickel chromium alloy, said blank being initially in the form of a substantially circular disc having a diameter which is greater than the diameter of the circular end face of the mandrel by an amount which exceeds at least 90% of the predetermined depth of said body;

b. applying said blank against the circular end face of the mandrel and carrying out the spinning process only to an extent sufficient to bend the blank so as to conform to the shape of said mandrel and to extend the blank along the length of said mandrel for a distance substantially equal to said predetermined depth of the body of the pot which is thereby produced.

Preferably, the difference between the initial diameter of the disc blank and the diameter of the circular end face of said mandrel will be greater than the depth of the pot body produced, and the said diameter of the disc blank may be greater than twice the said diameter of said mandrel end face. Also the total surface area of the disc blank before spinning will preferably be equal to at least 80% of, and desirably at least 85% of, the total surface area of the finished pot body.

The above conditions facilitate being able to produce, by spinning, the heat treatment pots with a sufficiently low degree of metal stretching and flow as to yield a satisfactory product. Thus, in contrast to conventional spinning techniques where substantial axial stretching and metal flow with consequent substantial reduction in thickness of the blank is considered to be necessary or important, at least when working heat resistant alloys of the kind involved, the production of axial tensile stresses and thinning of the metal in the side walls of the pots made in accordance with this invention maybe considerably reduced.

In carrying out the method in accordance with the invention as specified above, stretching and axial flow of the metal are preferably kept to a minimum by careful control of the spinning tool which may be withdrawn as soon as the blank is bent into conformity with the shape of the mandrel in use and reaches the desired dimensions. It will be appreciated that as a result of the smaller extent of stretching, axial flow and thinning of the metal as compared with conventional spinning techniques, a blank will be used which not only will have a larger diameter but which will also be thinner than the blank which would otherwise be used to produce a pot of given depth and wall thickness upon a given size of mandrel.

The invention also provides a heat treatment pot, which can be free from welds, spun from substantially circular blanks cut out from heat resisting alloy sheet following the method herein above defined. The invention further includes use of such pots in metal heat treatment salt bath processes.

For the purposes of the present invention, the nickel chromium alloys employed preferably should contain a nickel plus chromium content of at least 37% by weight with, at least the major part of the balance being iron. Usually, the nickel, chromium and iron contents taken together will be more than 90% by weight. Examples of alloys which may be used are shown in the following table:

TABLE 1

| Trade Name or Alloy Specification | 1 Nimonic 75 | 2 Inconel 600 | 3 Incalloy DS | 4 AISI 310 |
|---|---|---|---|---|
| Nickel | Balance | 72.0 min. | 34.0–41.0 | 20 |
| Chromium | 18.0–21.0 | 14.0–17.0 | 17.0–19.0 | 25 |
| Iron | 5.0 max. | 6.0–10.0 | Balance | Balance |
| Silicon | 1.0 max. | 0.5 max. | 1.7–2.7 | 1.5 max. |
| Percentages by weight | | | | |

In a typical process in accordance with the invention for producing, by spinning, a cylindrical heat treatment pot, a substantially circular disc blank of metal sheet comprising the nickel chromium heat resisting alloy is positioned centrally against the circular end face of a cylindrical mandrel having dimensions corresponding to the internal dimensions of the body of the pot to be produced, the mandrel being mounted in a metal spinning machine. The substantially circular disc blank is conveniently held against the end face of the mandrel by a hydraulically operated plunger or other suitable device. The mandrel together with the blank is then rotated and a spinning roller is applied to the blank at a point closely adjacent the periphery of said end face of the mandrel and is then passed across the blank towards the circumference thereof with movement and pressure in the longitudinal direction of the mandrel. By repeated passes of the roller, the metal sheet of the blank is eventually forced down to conform to the cylindrical shape of the mandrel. To facilitate this spinning process, the portion of the metal sheet of the blank which is being spun is also heated, the temperature used being generally at least 800°C and will usually, for example, be in the temperature range 800°C to 1000°C. Several suitable methods of localised heating are available, one being by oxy-propane torches.

In practice, the metal sheet of the disc blank, if unevenly heated during the initial stages, may tend to buckle and the buckled areas are liable to crack during spinning. To counter the tendency to buckling during heating, it is preferred to start spinning the disc blank cold to "set" it into a dished shape before heating is commenced. Thus, in many cases it has been found advantageous for the disc blank to be dished cold to a truncated conical shape with the conical sides extending at an angle of 5–15° to the plane of the portion of the blank clamped to the end face of the mandrel. This preset form of the blank does not then have the same tendency to buckle during initial heating.

As previously indicated, it would normally be considered usual in spinning metals containing heat resisting alloy to start with a metal disc blank of substantially smaller surface area and substantially greater thickness than the surface area and thickness required in the finished spinning and to flow or stretch the metal at the same time as thinning it in the process of spinning to shape. In carrying out the process of the present invention, however, one will start with a disc blank which would be larger in diameter and less in thickness than that considered normal in conventional spinning techniques for such metals as are presently involved, and this disc blank of unusual dimensions relative to the dimensions of the mandrel and finished product will be spun to shape with a minimum amount of stretching or flowing of the metal.

In the typical process outlined above, it will be appreciated that the disc blank of metal sheet is spun directly onto a parallel sided cylindrical mandrel corresponding in dimensions to the internal dimensions of the pot. It is however possible to carry out the spinning process in a plurality of stages using initially a mandrel or mandrels having an included angle or included angles of less than 180° to produce first a partly formed product. For example, in experimental work, mandrels having included angles of 70° and 90° have been used in initial forming stages, but it is not considered that the use of such initial forming stages involving mandrels of different dimensions will generally be found to be necessary for obtaining a satisfactory product.

In carrying out the invention, the metal sheet of the disc blank may be composed wholly of the heat resisting nickel chromium alloy, or alternatively it may be composed of a laminate metal sheet comprising a layer of mild steel (hereinafter referred to as carbon steel or carbon manganese steel) clad with a layer of the nickel chromium heat resisting alloy. In many cases, the latter composition is preferred as will be apparent from the following discussion.

It is known that heat treatment pots composed entirely of nickel chromium heat resisting alloy last longer with salt baths used for carburising, that is salt baths which generally contain cyanide and other additives, than do the same pots if used with salt baths of "neutral" salts which are basically chlorides with no cyanide. It is also known that heat resisting nickel chromium heat treatment pots used with the latter neutral salts usually fail by attack by the salt along the grain boundaries of the metal. This is believed probably to be due to dechromisation of the heat resisting alloy, but whatever the exact mechanism of the corrosion process it is clear that failure of the material is usually a result of intergranular attack, and the advance of the intergranular attack during such use of the pot is often appreciably faster than that of oxidation of the heat resisting alloy by the heating gases. Consequently, it is possible prematurely to perforate pots made from heat resisting nickel chromium alloy by the process of intergranular corrosion occuring in advance of serious damage by oxidation.

The above effect has been particularly observed in pots cast from heat resisting nickel chromium alloy, but it is believed that such intergranular corrosion may also produce failure in pots fabricated by other means from metal composed entirely of the heat resisting nickel chromium alloy when such pots are used with neutral salts as above referred to.

On the other hand, however, it has been found that heat treatment pots composed of carbon steels and carbon manganese steels do not fail in use with neutral salts by intergranular corrosion by the salt, but failure is usually always a result of general oxidation by the heating gases.

The production of heat treatment pots from metal sheet composed of carbon or carbon manganese steel clad on one side with heat resisting nickel chromium alloy can therefore give an advantage of combining the oxidation resisting properties of the heat resisting nickel chromium alloy with the resistance to intergranular corrosion of the carbon or carbon manganese steel.

In using such laminate metal sheet, the carbon or carbon manganese steel layer should be arranged to form the inside wall of the heat treatment pots so as to resist intergranular corrosion from the salt within and the nickel chromium alloy layer of the laminate should form the outside wall of the pots which will be exposed to contact with the oxidising heating gases.

Tests have shown that cylindrical heat treatment pots can be spun successfully from disc blanks formed of laminate consisting of ⅜ inch thick plates composed of carbon steel and a 17.5% thick coating or cladding of the nickel chromium heat resisting alloy material sold under the Trade Name of "Inconel".

In general, it is considered desirable that the heat resisting alloy portion of such laminate metal sheet used for producing heat treatment pots by spinning in accordance with this invention should have a thickness in the range 15% to 30% of the total thickness of the laminate, and often the preferred thickness for the alloy portion will lie in the range 20% to 25% of the total thickness. This can of course be varied, however, according to the requirements in respect of the type of salt used and the temperature at which the pot is to be used.

The examples of typical heat resisting nickel chromium alloys set out in the previous Table (Table 1) are suitable both for blanks composed entirely of such alloy or for the cladding layer of laminate metal sheet blanks of the kind mentioned above. For the carbon steel or carbon manganese steel component of such laminate metal sheet blanks, examples of typical compositions suitable are given by the analysis of compositions covered by specifications BS1501/151 grade 23 or BS1501/213 grade 28 which are detailed in Table 2 set out below.

TABLE 2

| Specification | Analysis % (Balance Iron) | | | | | | | | |
|---|---|---|---|---|---|---|---|---|---|
| | Carbon | Silicon | Manganese | Sulphur | Phosphorus | Nickel | Chromium | Molybdenum | Copper |
| BS 1501 – 151 grade 23 | 0.18 max. | 0.10 max. | 0.40 min.–1.20 max. | 0.05 max. | 0.05 max. | 0.30 max. | 0.25 max. | 0.10 max. | 0.20 max. |
| BS 1501 – 211 grade 26 | 0.17 max. | 0.10 max. | 0.90–1.50 | 0.05 max. | 0.05 max. | 0.30 max. | 0.25 max. | 0.10 max. | 0.20 max. |

The method of production of heat treatment pots in accordance with the invention using a spinning process can be basically the same, as previously outlined, irrespective of whether the metal sheet of the disc blanks is composed entirely of the heat resisting nickel chromium alloy or is made of a laminate comprising a layer of carbon or carbon manganese steel clad with the heat resisting nickel chromium alloy, but the invention will be further illustrated by specific examples of the spinning of a heat treatment pot given in the following description taken in conjunction with accompanying diagrammatic drawing.

In said drawing.

Figure 1:
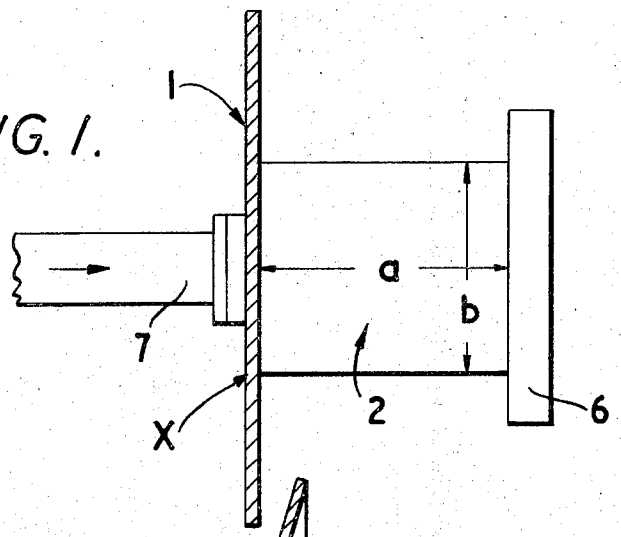
FIG. 1 is a sectional elevation of a disc blank of metal sheet clamped to the end face of a parallel sided cylindrical mandrel in a spinning machine.

In a first specific example, the disc blank, indicated by reference numeral 1 in FIG. 1 of the drawing was composed entirely of a heat resisting nickel chromium alloy which is commercially available under the Trade Name "Inconel 600" having the nominal composition shown in column 2 of the preceding Table 1. The disc blank 1 was of circular form having a diameter of 36 inches and a thickness of 3/16 inch, and was clamped centrally against the circular outer end face of the mandrel indicated by reference numeral 2 in FIG. 1. The mandrel had a diameter of 15¾ inches (dimension *b*) and a length of 18 inches (dimension *a*) up to but excluding a flange 6 at the inner end.

Figure 2:
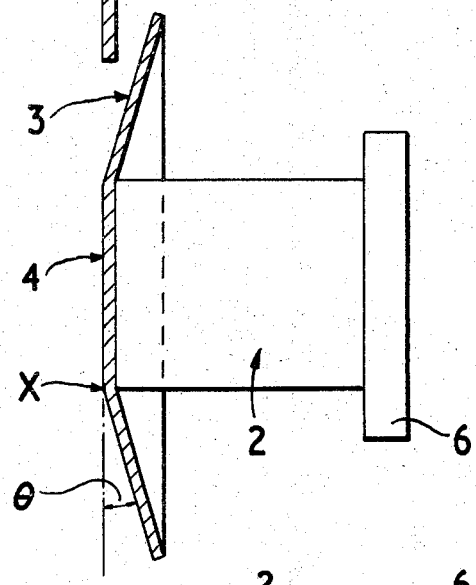
FIG. 2 is a sectional elevation of the disc blank on the mandrel after it has been dished cold into a truncated conical shape.

In this example, the mandrel 2 was rotated at a speed of approximately 200 revolutions per minute whilst a clamping plunger 7 under a load of 8 – 10 tons pressed the disc blank against the outer end face of the mandrel. A spinning roller was then applied, under a load of 500 lbs. per square inch, to the disc blank at the point X closely adjacent the periphery of the outer end face of the mandrel so as to dish the disc blank into the truncated conical shape shown in FIG. 2. At this stage, the conical wall 3 of the blank was at an angle ($\theta$) of 10° to the plane of the portion 4 against the outer end face of the mandrel.

Figure 3:
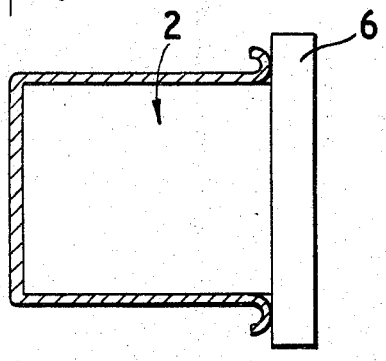
FIG. 3 is a sectional elevation of a spun pot, mounted on the mandrel, after having been produced by spinning the disc blank on the mandrel as in FIGS. 1 and 2.

Heating of the dished blank by means of oxy-propane torches was then commenced whilst maintaining the rotation at 200 revolutions per minute. When a temperature of approximately 800°C was achieved for the metal of the projecting portion of the blank, the spinning roller was re-applied to the blank commencing at point X again and traversing laterally, under a load of between 300 – 500 lbs. per square inch, towards the inner flange end of the mandrel. After a number of passes of the spinning roller over the blank in this manner, a finished spun pot of cylindrical form was produced as shown in FIG. 3. Heating of the metal was continued during most of the final spinning operation.

In a second example, disc blanks of circular form, having a diameter 34.75 to 35.0 inches were used produced from laminate metal sheet or plate composed of a layer of carbon steel corresponding to specification BS1501/151 grade 23 clad on one side with a closely adherent layer of Inconel heat resisting nickel chromium alloy, the metal sheet or plate being rolled to a final thickness of 10 millimetres made up of a thickness of 7.5 millimetres for the carbon steel layer and a thickness of 2.5 millimetres for the Inconel layer. The disc blanks were flame cut from the composite clad sheet or plate and the edges were turned down to give a final diameter of 34.5 inches before spinning.

The disc blanks were set up in a spinning machine, one by one, on a 15¾ inches diameter cylindrical mandrel, again as shown in FIG. 1, with the Inconel cladding layer presented outwards. A chlorinated paraffin wax, sold under the Trade Name "Cereclor", was applied to the surface of the Inconel layer to prevent scuffing during working and then, whilst the disc blank was rotated at approximately 200 revolutions per minute, a spinning roller was applied, again at the point X marked at FIG. 1, under pressure so as to dish the cold blank to the truncated conical shape shown in FIG. 2.

Then, heat was applied by means of oxy-propane torches until the dished portion of the blank attained a temperature of apporximately 800°C, whereupon the spinning roller was re-applied and traversed laterally towards the flange at the inner end of the mandrel under a load within the range 300 – 1000 lbs. per square inch. A number of passes were made in this manner with the spinning roller until the sheet or plate metal of the blank was forced down against the parallel sides of the mandrel, thereby forming a pot having a cylindrical body with the carbon steel layer forming the inner wall and a firmly adherent cladding of Inconel heat resisting nickel chromium alloy on the outside.

The above procedure was repeated using a total of ten disc blanks so as to produce a total of 10 15¾ inch diameter by 18 inch deep heat treatment salt bath pots of the clad material, all of which were found to be completely satisfactory.

I claim:

1. A method of producing a heat treatment pot having sufficient strength and resistance to chemical attack to resist wall failure over a useful service life when holding molten salts, comprising: providing a circular disc blank of metal sheet of a thickness of at least about 3/16 inch, said blank comprising heat resisting nickel chromium alloy; providing a mandrel having a parallel-sided cylindrical surface and a flat circular end face; and shaping the blank into a pot having substantially parallel sides by a metal spinning process which includes, at least in the final stages, applying the blank to the flat circular end face of the mandrel, pressing a spinning element against the blank to shape the blank into engagement with the cylindrical wall of the mandrel while controlling the spinning process to produce a pot body having a depth which is not greater than 110% of the difference between the initial diameter of the disc blank and the diameter of the circular end face of the mandrel, the pot having an internal shape complementary with the mandrel.

2. A method of producing a heat treatment pot for holding molten salts, wherein a metal spinning process is used to form the body of the pot from a substantially circular disc blank of metal sheet which comprises heat resisting nickel chromium alloy, the spinning process being carried out, at least in the final stages, while the blank is applied to a smaller diameter circular end face of a cylindrical mandrel having a shape complementary to the internal shape of the pot body finally producted and while pressing a spinning element against the disc blank, and controlling said spinning process so that the pot body thereby produced has substatially parallel sides and a depth which is not greater than 110% of the difference between the initial diameter of the disc blank and the diameter of said circular end face of said mandrel.

3. A method, as claimed in claim 1, wherein the depth of the pot body produced is less than the difference between the initial diameter of the disc blank and the diameter of said circular end face of said mandrel.

4. A method of producing a heat treatment pot, for holding molten salts, which has a substantially parallel-sided body of predetermined depth and of predetermined internal shape and cross-sectional dimensions, said method comprising forming the body of the pot by a metal spinning process utilising a cylindrical mandrel having a circular end face and having an external shape and cross-sectional dimensions complementary to the internal shape and dimensions of said body, said method further including the following steps:

a. providing a blank of metal sheet comprising heat resisting nickel chromium alloy, said blank being initially in the form of a substantially circular disc having a diameter which is greater than the diameter of the circular end face of the mandrel by an amount which exceeds at least 90% of the predetermined depth of said body;

b. applying said blank against the circular end face of the mandrel and carrying out the spinning process by pressing a spinning element against the blank only to an extent sufficient to bend the blank so as to conform to the shape of said mandrel and to extend the blank along the length of said mandrel for a distance substantially equal to said predetermined depth of the body of the pot which is thereby produced.

5. A method, as claimed in claim 4, wherein the blank in its initial form of a substantially circular disc has a diameter which is greater than the diameter of the circular end face of the mandrel by an amount which exceeds the predetermined depth of said body.

6. A method, as claimed in claim 3, wherein, the metal spinning process, the disc blank is clamped against the circular end face of said mandrel and is rotated, together with the mandrel, whilst a spinning roller is applied to the blank at a point closely adjacent the periphery of said end face of the mandrel and is then passed across the blank towards the circumference thereof with movement and pressure in the longitudinal direction of the mandrel, a plurality of such passes of the spinning roller being repetitively carried out until the metal sheet of the blank is eventually forced down to conform to the shape of the mandrel.

7. A method, as claimed in claim 6, wherein initial passes of the spinning roller are carried out with the disc blank unheated so as to spin or set cold said blank to a dished shape, said blank then being heated during subsequent passes of the spinning roller to complete the pot body forming operation.

8. A method, as claimed in claim 7, wherein the blank is locally heated to a temperature of at least 800°C after the initial cold setting and during the subsequent passes of the spinning roller.

9. A method, as claimed in claim 7, wherein the dished shape to which the blank is spun or set cold is a substantially truncated conical shape with the conical sides extending at an angle within the range 5°–15° to the end face of the mandrel.

10. A method, as claimed in claim 4, wherein the total surface area of the disc blank before spinning is equal to at least 80 percent of the total surface area of the pot body produced.

11. A method, as claimed in claim 4, in which the total surface area of the disc blank before spinning is equal to at least 85 percent of the total surface area of the pot body produced.

12. A method, as claimed in claim 4, in which the heat resisting nickel chromium alloy has a total nickel plus chromium content of at least 37 percent by weight with at least the major part of the balance being iron.

13. A method, as claimed in claim 12, wherein the total nickel, chromium and iron contents of the nickel chromium alloy collectively total more than 90 percent by weight of the composition of said alloy.

14. A method, as claimed in claim 4, wherein the disc blank is composed wholly of the heat resisting nickel chromium alloy.

15. A method, as claimed in claim 4, wherein the disc blank is composed of a laminate metal sheet comprising a layer or carbon steel or carbon manganese steel clad with a layer of said heat resisting nickel chromium alloy.

16. A method, as claimed in claim 15 wherein the layer of carbon steel or carbon manganese steel is arranged to form the inside of the heat treatment pot produced, with the nickel chromium alloy layer forming the outside wall of said pot.

17. A method, as claimed in claim 15, in which the nickel chromium alloy layer of the laminate metal sheet of the disc blank has a thickness in the range 15% to 30% of the total thickness of the laminate metal sheet.

18. A method, as claimed in claim 15, in which the nickel chromium alloy layer of the laminate metal sheet of the disc blank has a thickness in the range 20% to 25% of the total thickness of the laminate metal sheet.

19. A method, as claimed in claim 4, wherein the initial diameter of the circular disc blank is greater than twice the diameter of the circular end face of said mandrel.

20. A heat treatment pot produced in accordance with the method of claim 4.

21. A metal heat treatment process involving treatment of metal workpieces with molten salt mixtures at temperatures within a range 700° – 1050°C carried out in a heat treatment pot as claimed in claim 20.

* * * * *